United States Patent [19]

Harrison et al.

[11] 4,270,252

[45] Jun. 2, 1981

[54] APPARATUS TO COUNT AND CONTROL CRIMPS IN A MOVING TOW OF YARN

[75] Inventors: David M. Harrison, Chester, Va.; Walter E. Watson, III, Beckley, W. Va.; Maurice S. Moore, Hopewell, Va.; Roger E. Jermyn, Columbia, S.C.

[73] Assignee: Allied Chemical Corporation, Morristown, N.J.

[21] Appl. No.: 866,303

[22] Filed: Jan. 3, 1978

[51] Int. Cl.[3] ..... D02G 1/12

[52] U.S. Cl. ..... 28/250; 356/23; 356/376; 356/429

[58] Field of Search ..... 28/250; 356/23, 238, 356/376, 429

[56] References Cited

U.S. PATENT DOCUMENTS

| | | | |
|---|---|---|---|
| 2,991,685 | 7/1961 | Van Dongeren | 356/429 |
| 3,907,440 | 9/1975 | Eichenberger | 356/429 |
| 4,019,066 | 4/1977 | Lucas et al. | 356/429 X |
| 4,057,350 | 11/1977 | Craig | 356/429 |
| 4,124,300 | 11/1978 | Mead et al. | 356/429 |

FOREIGN PATENT DOCUMENTS

| | | | |
|---|---|---|---|
| 1473727 | 6/1969 | Fed. Rep. of Germany | 356/429 |
| 2228502 | 12/1973 | Fed. Rep. of Germany | 356/23 |
| 50-18099 | 6/1975 | Japan . | |
| 1497269 | 1/1978 | United Kingdom . | |

OTHER PUBLICATIONS

Puchegger, F. *New Method to Determine the Crimp of Individual Staple Fibers,* Meilliand Textilberichte, pp. 110–113, Feb. 1979.

*Crimp Characterization Instrument,* Research Disclosure, Apr. 1974, 544090046, No. 120, pp. 48–50.

*Primary Examiner*—Robert Mackey

*Attorney, Agent, or Firm*—Richard A. Anderson

[57] ABSTRACT

Apparatus is disclosed to count and control crimps in a moving tow of yarn. The apparatus comprises a target (the tow of yarn), a stroboscopic light, condenser lens, mirror, transparent support for the target, focusing lens, diode array to sense variations in light intensity from the striations in the target, electronic board circuit with terminal board, programmable calculator, and read-out means, such as a light emitting diode display. When used to control the crimping apparatus it also comprises a controller, exit control gate of the crimper and means to exert pressure on the exit control gate. The method for use of this apparatus is to cause an intense light pulse to issue from the stroboscopic light, passing the pulse of light through the condenser lens against the mirror through the transparent support to reflect from the striations in the yarn tow back through the focusing lens into the diode array which counts the variations in light intensity caused by the striations. The variations counted are transmitted from the diode array as an electronic signal to optional storing and averaging means, such as a programmable calculator, then a read-out device. When controlling crimp, the signal is transmitted to a controller which influences a means to change crimp in the crimping apparatus, such as pressure on the exit control gate of a stuffer box crimper.

18 Claims, 3 Drawing Figures

APPARATUS TO COUNT AND CONTROL CRIMPS IN A MOVING TOW OF YARN

BACKGROUND OF THE INVENTION

This invention relates to an apparatus and method to count closely spaced variations of light intensity; more specifically, it relates to a method and apparatus to count crimps in a moving tow of yarn. The method and apparatus can also be used whenever the number of striations in a target is required to be counted.

The amount of crimp or number of crimps per inch is an important parameter in the useful properties of natural or synthetic yarns used to manufacture apparel, carpet or other fabrics where bulkiness is required.

The most common method of counting the number of crimps per inch in yarn has been to cut away the sample, magnify it, and count the number of crimps by the human hand and eye. This slow and expensive method does not make possible in-line control of a crimping apparatus to control the number of crimps per inch during the crimping process. An instantaneous measurement, if only to indicate a quick measurement for operator control, has been a desirable need in the art. Either or both of these needs have been met with applicants' invention.

However, it is known in the prior art in Japanese Pat. No. 50-18,099 to Toray Industries to continuously measure the number of crimps with a light source arranged so that the angle of the ray projected reflects at a specific angle into a photoelectric tube and the number of crimps is measured by detecting the overall intensity (not the closely spaced variations) of the reflected ray. This disclosure is the only disclosure known to us of a method and apparatus to measure the number of crimps in tow. Other less pertinent patents are as follows:

U.S. Pat. No. 3,709,610 measures the thickness of a filament using a known wavelength light, such as a laser, and picking up the diffraction pattern of the refracted light passing through the single filament in a detector array and the spacings between the light and dark portions of the diffraction pattern is measured to provide an indication of the diameter of the filament.

U.S. Pat. No. 3,719,425 is also a method for measuring the dimension of an object by employing a Topler optical arrangement where light rays reflected from a parallel path are conducted to a photoelectric receiver which provides an electrical output signal responsive to the intensity of the deflected light rays. The intensity is a measure of the dimension of the object.

U.S. Pat. No. 3,669,552 is a method and apparatus for spreading and counting filaments in a yarn. A continuous light source is used and the filaments must traverse a slot over a photocell in order to be counted.

U.S. Pat. No. 3,777,557 takes a series of photographs using a stroboscopic light as a single strand is tested by applying force to stretch it.

In U.S. Pat. No. 3,936,917, automatic control of the discharge end of a stuffer box crimper is disclosed. The controller is connected to a jet pressure sensor which controls the exit gate at the crimper box to control the exit location of the end of the crimped wad of yarn.

U.S. Pat. No. 3,814,494 discloses uniformly scaning a flat surface of a paper sheet by reflecting it with a rotating mirror from a light beam.

SUMMARY OF THE INVENTION

The apparatus and method we have invented is broadly used to count closely spaced variations of light intensity or to count striations on a target. The apparatus is broadly, in combination, a target having striations to cause variation in light intensity from light transmitted through or reflected therefrom, a stroboscopic light, condenser lens, a diode array to sense said variations in intensity of light and transmit an electronic signal in response, means to read-out the electronic signal, and means to trigger the stroboscopic light. The stroboscopic light is located to transmit an intense light pulse, initiated by the means to trigger, through the condenser lens and then through or reflected from the target onto the diode array. The diode array is electrically connected to the read-out means, so that the number of striations on the target is indicated. The method broadly comprises causing an intense light pulse to issue from a stroboscopic light, then passing the pulse through a condenser lens, then reflecting the pulse against the target, then focusing the reflected pulse onto the diode array to sense and transmit as an electronic signal variations in light intensity from striations in the target, and finally reading out the electronic signal.

In a preferred embodiment, the apparatus to count crimps in a moving tow of yarn comprises, in combination, a stroboscopic light, a condenser lens, a mirror, a transparent support for the tow, a focusing lens, a diode array to sense and transmit as an electronic signal variations in intensity of light from striations in the tow caused by crimps, an electronic board circuit, an electronic terminal board, a programmable calculator, a light emitting diode digital read-out device, and an enclosure to support the light, lens, mirror, array, circuit and board. The light, condenser lens, mirror, focusing lens, diode array, circuit and terminal board are all mounted in the enclosure, with the light mounted below the condenser lens and the mirror mounted above the condenser lens so that light is directed through the condenser lens and reflected from the mirror through the transparent support onto the moving tow and then reflected from the tow into the focusing lens mounted above the diode array. The diode array, mounted below the focusing lens, so that the light is focused onto the diode array causes an electronic signal to be transmitted through the electronic circuit and terminal board to the programmable calculator which averages multiple signals and transmits an electronic signal to the read-out device. This provides a reading of the number of crimps per inch of the tow.

A specific method to count crimps in a moving tow of yarn and to control the number of crimps in the yarn being continuously crimped by a crimping apparatus comprises causing an intense light pulse to issue from a stroboscopic light at an interval of between about 0.5 second to about two minutes, then passing the pulse through the condenser lens, then reflecting the pulse from a mirror through a transparent support for the tow onto the tow, then reflecting the pulse from the tow into a focusing lens, then focusing the focused light pulse onto a diode array to sense and transmit as an electronic signal variations in light intensity from striations in the tow of yarn caused by crimps in the yarn, then transmitting the signal through an electronic board circuit and terminal board to a programmable calculator which stores and averages the signals, then transmitting the averaged signals as another signal to a controller which controls the pressure on the tow of yarn by the exit control gate in the crimping apparatus, and also transmitting the averaged signals to a light emitting diode display read-out device. This control on the gate of the crimping apparatus causes more or less crimping of the tow of yarn to achieve control to a set crimp level.

In the board apparatus concept, the target can be moving; and the combination can also include a focusing lens and mirror, with the focusing lens being located so that the light reflected from the target is focused onto the diode array and the mirror is located so that the pulse of the stroboscopic light is reflected onto the target and the apparatus is located on the same side of the target as the pulse is reflected from. The combination can also include electronic means to convert the electronic signal from a diode array to data bits with the electronic signal transmitted by a diode array being converted to the data bit and then transmitted to the read-out means. This broad concept can also include a transparent support for the target; and the combination can also include a programmable calculator which stores and averages the signals from the diode array and then transmits the average signal as another signal to the read-out device.

In a slightly different embodiment, the stroboscopic light is located on the opposite side of the target or tow of yarn to the diode array and the pulse of light can pass through the target to the array, when the target is at least translucent. The means to trigger the stroboscopic light can be a timing means. In the apparatus used to control, the combination can also include a controller and crimping means, including an exit control gate having pressure exerted thereon by a fluid, such as hydraulic or pneumatic, cylinder when the moving target is a moving tow of yarn exiting from the crimping device. Then, the controller controls the discharge of yarn tow from the crimping means by regulating the pressure on the exit control gate by the fluid cylinder in response to the signal from the programmable calculator.

In the broader concept, the controlling apparatus combination can also include controller and crimping means, including a means to exert pressure on the crimping means, such as by exerting pressure on the exit of the crimping means, and the controller controls the discharge of yarn tow from the crimping apparatus by regulating the pressure means in response to any signal from the diode array or the signal from either the electronic means to convert the signal from the diode array to data bits or the programmable calculator. Another method to control crimp would be by controlling the pressure of steam entering the crimp box of the crimping means.

The crimping means may be the conventional stuffer crimping box, the fluid jet crimping apparatus known in the art, or the like.

The read-out means can be a light emitting diode or any type of printing means and the like.

In the broad method concept, the target can be moving; and the pulse from the stroboscopic light can be reflected from a mirror onto the target. Also, the pulses can be caused at a regular interval, such as from about 0.1 second to about 5 minutes, or, preferably, from about 0.5 second to about 0.5 minute.

In a slightly different embodiment, the method can comprise causing an intense light pulse to issue from the stroboscopic light, then passing the pulse through condenser lens, then passing the pulse through the target which is at least translucent, then focusing the pulse onto a diode array to sense and transmit as an electronic signal variations in light intensity from the striations on the target, and reading out the electronic signal.

Also, in addition to the broad concept the signals can be transmitted to a programmable calculator which stores and averages the signals then transmits the averaged signals as another signal to be read out.

The method to control the number of crimps in a moving tow of yarn comprises counting the crimps in the moving tow by causing an intense light pulse to issue from a stroboscopic light, then passing the light pulse through a condenser lens, then reflecting the pulse against the moving tow of yarn, then focusing the reflected pulse onto a diode array to sense and transmit as an electronic signal variations in light intensity from striations in the tow caused by crimps, and transmitting the signal to a controller. Then, controlling the number of crimps in the tow is done by receiving the signal at the controller, then responding to the signal with the controller, to continuously and proportionally influence a means to change the crimp level and a means to crimp the tow of yarn in response to the count of crimps indicated by the signal, so that more or less crimping of the tow of yarn occurs to achieve control to a set level of crimps.

In addition, the additional steps embodying the additional elements described in the preceding paragraphs can be combined with the steps given just above.

DESCRIPTION OF THE PREFERRED EMBODIMENT

Figure 1:
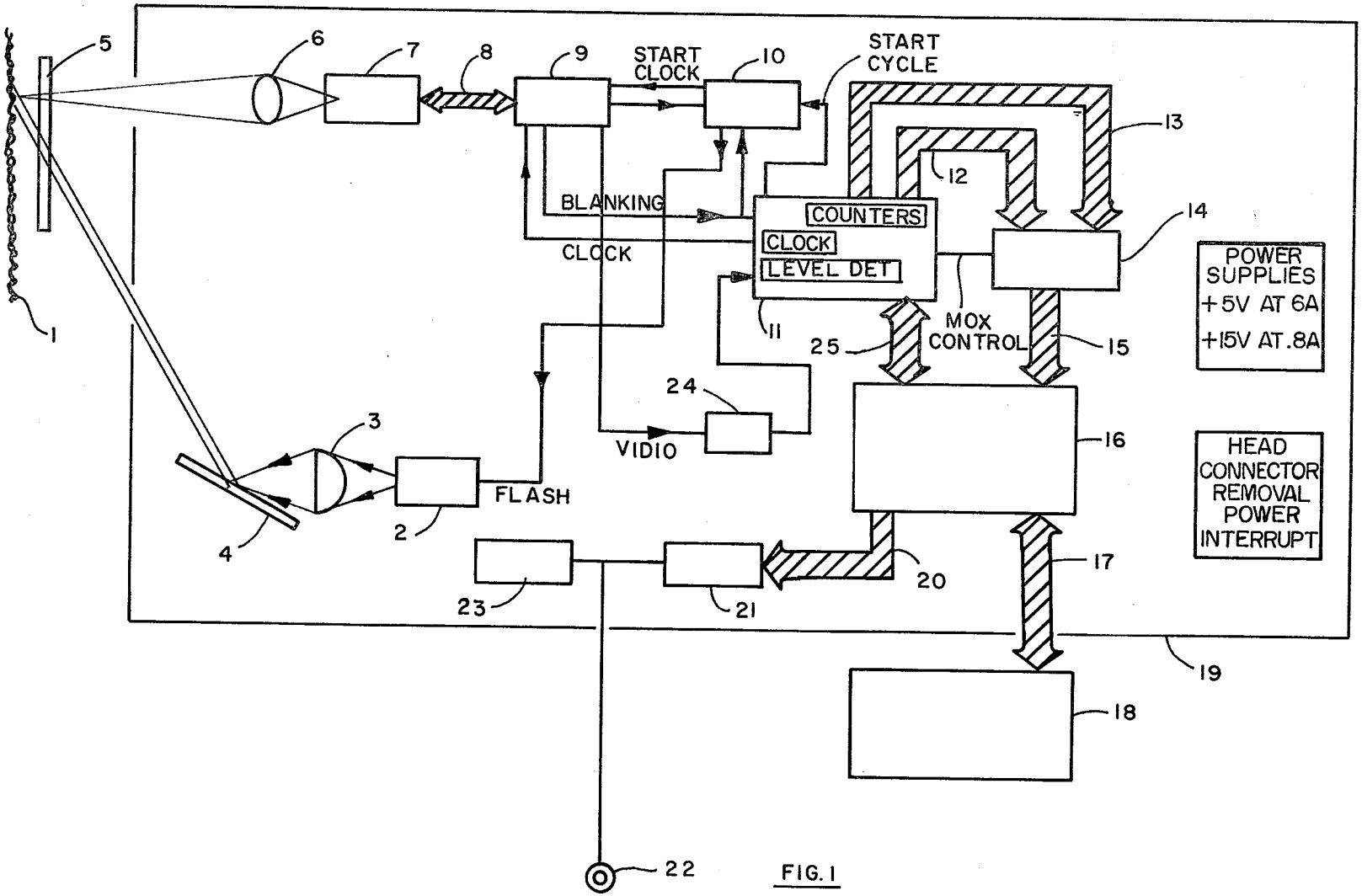
FIG. 1 is a schematic diagram showing the apparatus and demonstrating the method of this invention.

In all the figures, like numbers indicate like elements. FIG. 1 shows yarn tow 1 above its transparent support 5. Stroboscopic light 2 issues a pulse of light through condenser lens 3 reflected from mirror 4 through transparent support 5 onto tow 1 and thence reflected back through focusing lens 6 onto diode array 7. Diode array 7, more specifically a scanner photodiode array, senses variations in intensity of light from the striations in the tow caused by crimps and transmits an electronic signal in response through electrical cable 8 to diode array driver board 9 and thence to array output analyzer 10 which is controlled by system control board 11. System control board 11 also receives a signal from diode array board 9 and in return uses a clock to time the stroboscopic flashes or pulses to diode array driver board 9 and diode array output analyzer 10. Diode array driver board 9 also is connected electrically to programmable filter 24 to a level detector in system control board 11. Counters in system control board 11 communicate the number of zero crossings and spacing through cables 13 and 12, respectively, to bit multiplexer 14 which in turn transmits through digit data bus 15 the data bits to BCD interface 16 which communicates with programmable calculator 18 through data bus 17. BCD interface 16 also receives and sends through bi-direction communication bus 25 and communicates through BCD output cable 20 to three-digit BCD 21 which in turn communicates with 2.5 digit panel meter 23 and read-out analog device 22, such as a light emitting diode display. An outline of enclosure 19 is shown.

Figure 2:
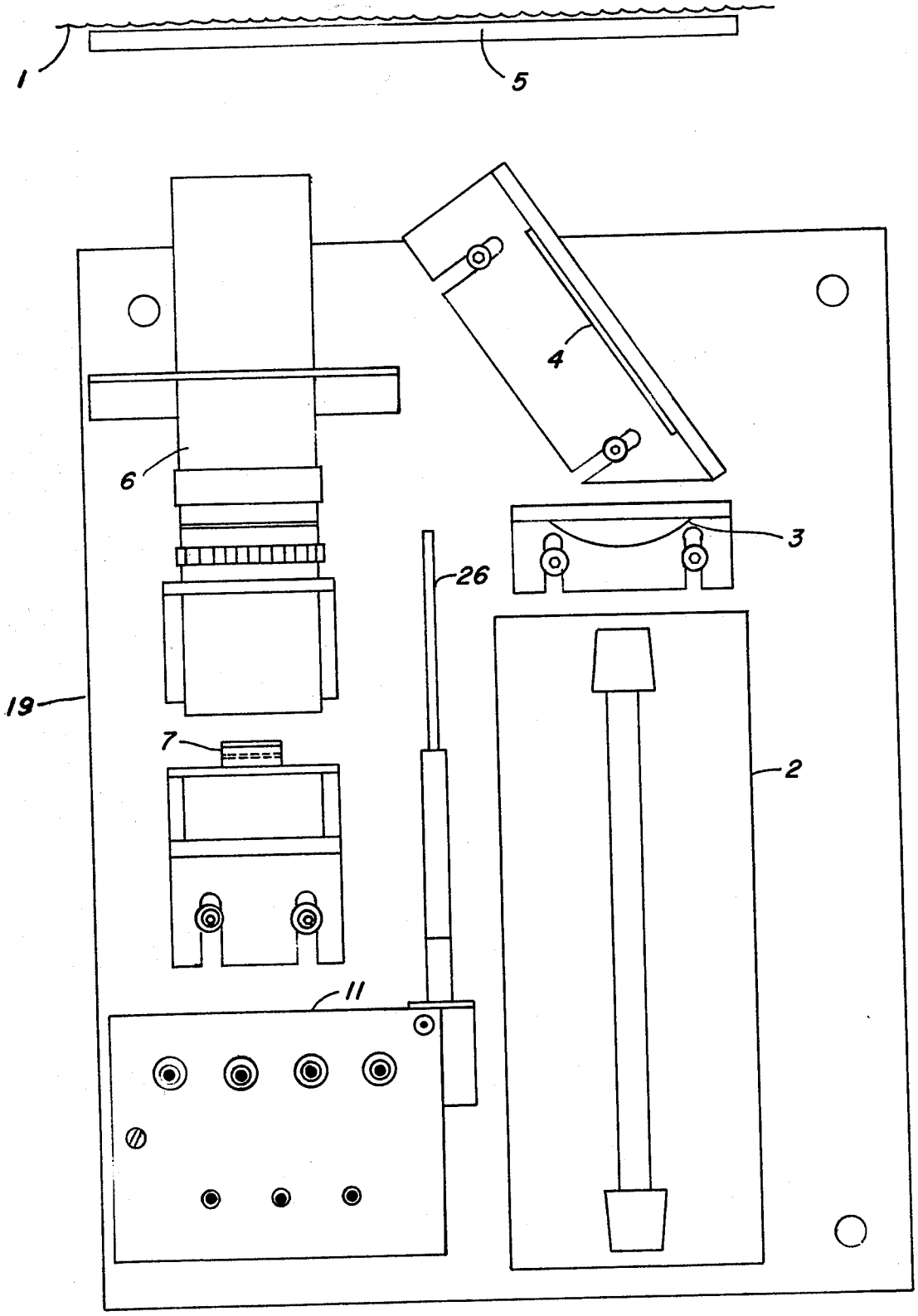
FIG. 2 is a front view of the inside of the control enclosure showing the basic elements of the apparatus of this invention.

In FIG. 2, the mechanical layout of the inside of enclosure 19 is shown. Conway/Helios stroboscope 2 transmits light pulses through condenser lens 3 to reflect from mirror 4 through transparent support 5 onto tow 1, the pulse reflected from tow 1 passes back through transparent support 5 through focusing lens 6 to diode array 7. System control board 11 and electronic board 26 are also shown.

Figure 3:
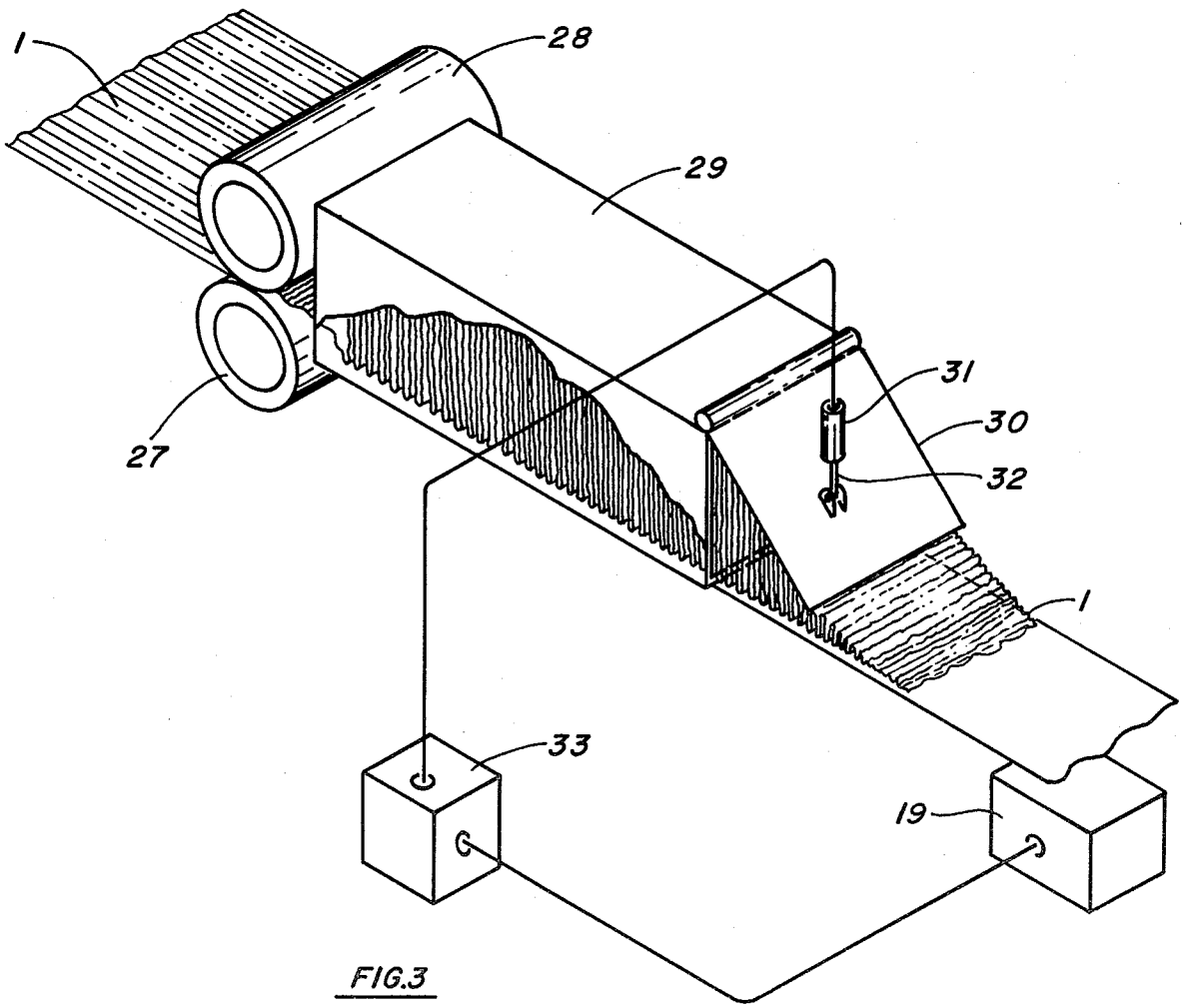
FIG. 3 is a schematic diagram showing the apparatus of this invention used to control the pressure on the exit gate of a crimping apparatus.

The apparatus used to control crimping in crimp box 29 is shown in FIG. 3. Tow of yarn 1 passes through nip rolls 27 and 28 to crimp box 29 and exits past exit control gate 30 to pass over control enclosure 19. Control enclosure 19 transmits a signal communicating with controller 33 which communicates with fluid cylinder (pneumatic or hydraulic) 31 which exerts force through connecting rod 32 on crimp box exit control gate 30. Thus, the number of crimps per inch is increased when more pressure is exerted on crimp box exit control gate 30 and less crimps result when the pressure is lessened by the control mechanism on crimp box exit control gate 30.

Figures 4, 5, 6:
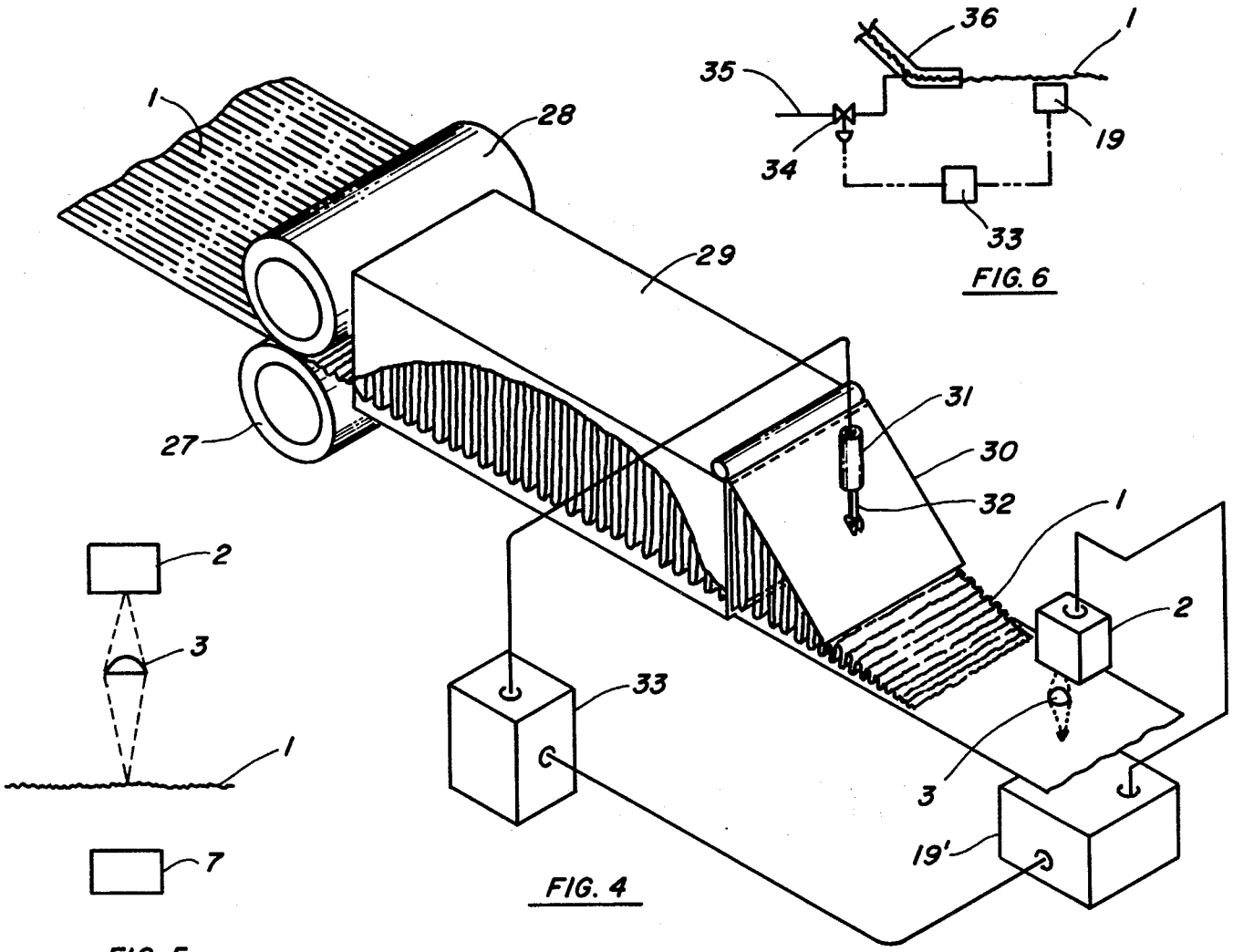
FIGS. 4–6 are schematic diagrams showing various embodiments of the invention.

FIG. 4 shows the embodiment where the stroboscopic light 2 and condenser lens 3 are positioned above the tow 1 so that diode array 7 within enclosure 19' reads the striations caused by variations in light passing through translucent tow 1 due to crimps.

FIG. 5 shows an embodiment like FIG. 4 but omitting focusing lens 6.

FIG. 6 shows the embodiment where controller 33 receives a signal from control enclosure 19 and transmits a signal to control valve 34 to control steam through line 35 emitting into steam jet texturizer 36, which textures tow 1.

We claim:

1. An apparatus to count crimps in a moving tow of yarn comprising, in combination, a stroboscopic light,
a condenser lens,
a mirror,
a transparent support for said tow,
a focusing lens,
a diode array to sense and transmit as an electronic signal variations in intensity of light from striations in said tow caused by crimps,
an electronic board circut,
an electronic terminal board,
a programmable calculator,
a light-emitting diode digital read-out device, and
an enclosure to support said light, lenses, mirror, array, circuit and board, said light, condenser lens, mirror, focusing lens, diode array, circuit and terminal board, mounted inside said enclosure, with said light mounted below said condenser lens, and said mirror mounted above said condenser lens so that light is directed through said condenser lens, and reflected from said mirror through said transparent support onto said moving tow and reflected from said tow into said focusing lens mounted above said diode array and thence into said diode array, which is mounted below said focusing lens so that said light is focused onto said diode array, causing said electronic signal transmitted by said diode array to be transmitted through said electronic circuit and terminal board to said programmable calculator which averages multiple signals and transmits an electronic signal to said read-out device, thereby providing a reading of the number of crimps per inch of said tow.

2. An apparatus to count closely spaced variations of light intensity in a single pulse of light transmitted from a target having striations to cause said variations in light intensity comprising, in combination a stroboscopic light,
a condenser lens,
a mirror,
a focusing lens,
a scanner photodiode array to sense said variations in intensity of light in said single pulse and transmit an electronic signal in response,
means to read out said electronic signal, and
means to trigger said stroboscopic light, said stroboscopic light being located to transmit intense light pulses, initiated by said means to trigger, to pass through said condenser lens and then to and from said target onto said scanner photodiode array, said scanner photodiode array being electrically connected to counter means to count the number of variations in said single pulse of light and to said read-out means so that the number of striations on the target is indicated, said focusing lens being located so that light reflected from said target is focused onto said diode array, and said mirror being located so that said pulse of stroboscopic light is reflected onto said target and said apparatus is located on the same side of said target as said pulse is reflected from.

3. The apparatus of claim 2 wherein the combination also includes a transparent support for said target.

4. The apparatus of claim 2 wherein the combination also includes a controller and a crimping means, including a means to exert pressure on the exit of said crimping means, and said target is a moving tow of yarn exiting from said crimping device, whereby said controller controls discharge of said yarn tow from said crimping means by regulating said pressure means in response to said signal.

5. The apparatus of claim 2 wherein the combination includes means to move said target.

6. The apparatus of claim 5 wherein the combination includes electronic means to convert said electronic signal from said diode array to a data bit and said electronic signal transmitted by said diode array is converted to data bits and then transmitted to said read-out means.

7. The apparatus of claim 6 wherein the combination also includes a controller and a crimping means, including an exit control gate having pressure exerted thereon by a fluid cylinder and said moving target is a moving tow of yarn exiting from said crimping device, whereby said controller controls discharge of said yarn tow from said crimping means by regulating said pressure on said exit control gate by said fluid cylinder in response to said signal from said electronic means to convert said electronic signal to data bits.

8. The apparatus of claim 5 wherein the combination also includes a transparent support for said target.

9. The apparatus of claim 8 wherein the combination also includes a controller and a crimping means, including an exit control gate having pressure exerted thereon by a fluid cylinder and said moving target is a moving tow of yarn exiting from said crimping device, whereby said controller controls discharge of said yarn tow from said crimping apparatus by regulating said pressure on said exit control gate by said fluid cylinder in response to said signal.

10. The apparatus of claim 8 wherein the combination also includes a programmable calculator which stores and averages said signals from said diode array and then transmits said averaged signals as another signal to said read-out device.

11. The apparatus of claim 10 wherein the combination also includes a controller and a crimping means, including an exit control gate having pressure exerted thereon by a fluid cylinder and said moving target is a moving tow of yarn exiting from said crimping device, whereby said controller controls discharge of said yarn tow from said crimping apparatus by regulating said pressure on said exit control gate by said fluid cylinder in response to said signal from said programmable calculator.

12. The apparatus of claim 5 wherein said means to trigger said stroboscopic light is a timing means.

13. The apparatus of claim 12 wherein the combination includes a transparent support for said moving target and the combination also includes electronic means to convert said electronic signal from said diode array to data bits and said electronic signal transmitted by said diode array is converted to data bits, then transmitted to said read-out means.

14. The apparatus of claim 13 wherein the combination also includes a programmable calculator which stores and averages said signals, then transmits said average signals as another signal to said read-out device.

15. The apparatus of claim 14 wherein the combination also includes a controller and a crimping means, including an exit control gate having pressure exerted thereon by a fluid cylinder and said moving target is a moving tow of yarn exiting from said crimping means, whereby said controller controls discharge of said yarn tow from said crimping means by regulating said pressure on said exit control gate by the fluid cylinder in response to said signal from said programmable calculator.

16. The apparatus of claim 5 wherein the combination also includes a controller and a crimping means, including an exit control gate having pressure exerted thereon by a fluid cylinder, and said moving target is a moving tow of yarn exiting from said crimping device, whereby said controller controls discharge of said yarn tow from said crimping means by regulating said pressure on said exit control gate by said fluid cylinder in response to said signal.

17. An apparatus to count closely spaced variations of light intensity in a single pulse of light transmitted from a target having striations to cause said variations in light intensity comprising, in combination a stroboscopic light,
a condenser lens,
a scanner photodiode array to sense said variations in intensity of light in said single pulse and transmit an electronic signal in response,
means to read-out said electronic signal,
means to trigger said stroboscopic light,
means to move said target,
a controller,
crimping means, and
means to exert pressure on said crimping means, said stroboscopic light being located to transmit intense light pulses, initiated by said means to trigger, to pass through said condenser lens and then to and from said target onto said scanner photodiode array, said scanner photodiode array being electrically connected to counter means to count the number of variations in said single pulse of light and to said read-out means so that the number of striations on the target is indicated, and said moving target is a moving tow of yarn exiting from said crimping means, whereby said controller controls discharge of said yarn tow from said crimping means by regulating said pressure means in response to said signal.

18. An apparatus to count crimps in a moving tow of yarn exiting from a crimping means comprising, in combination, a stroboscopic light,
a timing means to trigger said stroboscopic light,
a condenser lens,
a mirror,
a transparent support for said tow,
a focusing lens,
a diode array to sense and transmit as an electronic signal variations in intensity of light from striations in said tow caused by crimps,
an electronic means to convert said signal to a data bit,
an electronic board circuit,
an electronic terminal board,
a programmable calculator,
a light-emitting diode digital read-out device,
an enclosure to support said light, lenses, mirror, array, circuit and board,
a controller,
an exit control gate on said crimping means,
a fluid cylinder, said light, condenser lens, mirror, focusing lens, diode array, circuit and terminal board, mounted inside said enclosure, with said light mounted below said condenser lens, and said mirror mounted above said condenser lens so that light is directed through said condenser lens, and reflected from said mirror through said transparent support to be transmitted through said electronic circuit to said electronic means to convert said signal and to said terminal board as a data bit to said programmable calculator which averages multiple signals and transmits an electronic signal to said read-out device, thereby providing a reading of the number of crimps per inch of said tow, said exit control gate having pressure exerted thereon by said fluid cylinder, and said controller controlling discharge of said yarn tow from said crimping means by regulating said pressure on said exit control gate by the fluid cylinder in response to said signal from said programmable calculator.

* * * * *